US006234834B1

(12) United States Patent
Tsai et al.

(10) Patent No.: US 6,234,834 B1
(45) Date of Patent: May 22, 2001

(54) STACKED ELECTRICAL CONNECTOR ASSEMBLY

(75) Inventors: Hui Tze Tsai; Nan-Tsung Huang; Kun-Tsan Wu, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/473,776

(22) Filed: Dec. 29, 1999

(30) Foreign Application Priority Data

Dec. 17, 1999 (TW) ..... 88221555

(51) Int. Cl.[7] ..... H01R 12/20
(52) U.S. Cl. ..... 439/541.5; 439/101
(58) Field of Search ..... 439/541.5, 79, 439/101, 108, 607, 609

(56) References Cited

U.S. PATENT DOCUMENTS 5,417,585 * 5/1995 Morin et al. ..... 439/541.5
5,613,880 * 3/1997 Wang ..... 439/541.5
5,709,554 * 1/1998 Savage, Jr. ..... 439/541.5

* cited by examiner

*Primary Examiner*—Gary F. Paumen
(74) *Attorney, Agent, or Firm*—Wei Te Chung

(57) ABSTRACT

A stacked electrical connector comprises triple stacked dielectric housings with a similar structure, a bottom, a middle and a top conductive terminal groups and two sets of transition contacts engaging with the middle and the top terminal groups, a one-piece grounding contact having three contacting arms inserting into the three stacked housings, a spacer and a conductive shield enclosing the stacked housings and the two sets of the transition contacts. The middle and the top terminal groups have a same structure, thereby simplifying the manufacture of the stacked electrical connector. An upper and a lower retaining blocks are prepared for fastening to the middle and the top housings. The spacer forms a pair of latching posts engaging with the lower retaining block for fixing the stacked housings against the spacer and defines a plurality of grooves to position the two sets of transition contacts.

1 Claim, 5 Drawing Sheets

STACKED ELECTRICAL CONNECTOR ASSEMBLY

BACKGROUND OF THE INVENTION

The present invention relates to an electrical connector assembly, and particularly to a triple-stacked electrical connector assembly which provides sets of new and improved contacts and an improved spacer.

With the trend toward miniaturization in computer technology, a variety of stacked electrical connectors have been developed. A typical stacked connector comprises a lower and an upper dielectric housing arranged in an overlapped relationship for reducing the space occupied in a computer, plus a terminal module received in each housing. Each terminal module has a plurality of conductive terminals parallel to one another and each terminal comprises an integrally formed retaining portion depending downward for inserting into a corresponding through-hole of a printed circuit board. Additionally, a spacer is used to keep the terminals in correct alignment and pitch. Therefore, the retaining portions of the terminal module assembled in the upper dielectric housing are comparatively long, resulting in difficult positioning. Furthermore, the two-level terminal modules must be separately manufactured, thereby complicating the manufacturing process and the assembly/disassembly of the stacked electrical connector. In addition, the stacked housings may not be correctly positioned because they lack suitable retaining means.

Hence, an improved stacked electrical connector is required to overcome the disadvantages of the prior art.

BRIEF SUMMARY OF THE INVENTION

A first object of the present invention is to provide a triple-stacked electrical connector which comprises two sets of transition contacts separately manufactured to facilitate the assembly and disassembly of the electrical connector;

Another object of the present invention is to provide a triple-stacked electrical connector which provides a spacer for positioning the transition contacts and fixing the stacked housings thereto.

Yet still another object of the present invention is to provide a stacked electrical connector which provides a one-piece grounding contact for simplifying the manufacture of the electrical connector.

A stacked electrical connector in accordance with the present invention comprises triple stacked dielectric housings with a similar structure, a bottom, a middle and a top conductive terminal groups and two sets of transition contacts engaging with the middle and the top terminal groups, a one-piece grounding contact having three contacting arms inserting into the three stacked housings, a spacer and a conductive shield enclosing the stacked housings and the two sets of the transition contacts. The middle and the top terminal groups have a same structure, thereby simplifying the manufacture of the stacked electrical connector. An upper and a lower retaining blocks are prepared for fastening to the middle and the top housings. The spacer forms a pair of latching posts engaging with the lower retaining block for fixing the stacked housings against the spacer and defines a plurality of grooves to position the two sets of transition contacts.

Other objects, advantages and novel features of the invention will become more apparent from the following detailed description of the present embodiment when taken in conjunction with the accompanying drawings.

DETAILED DESCRIPTION OF THE INVENTION

Figure 1:
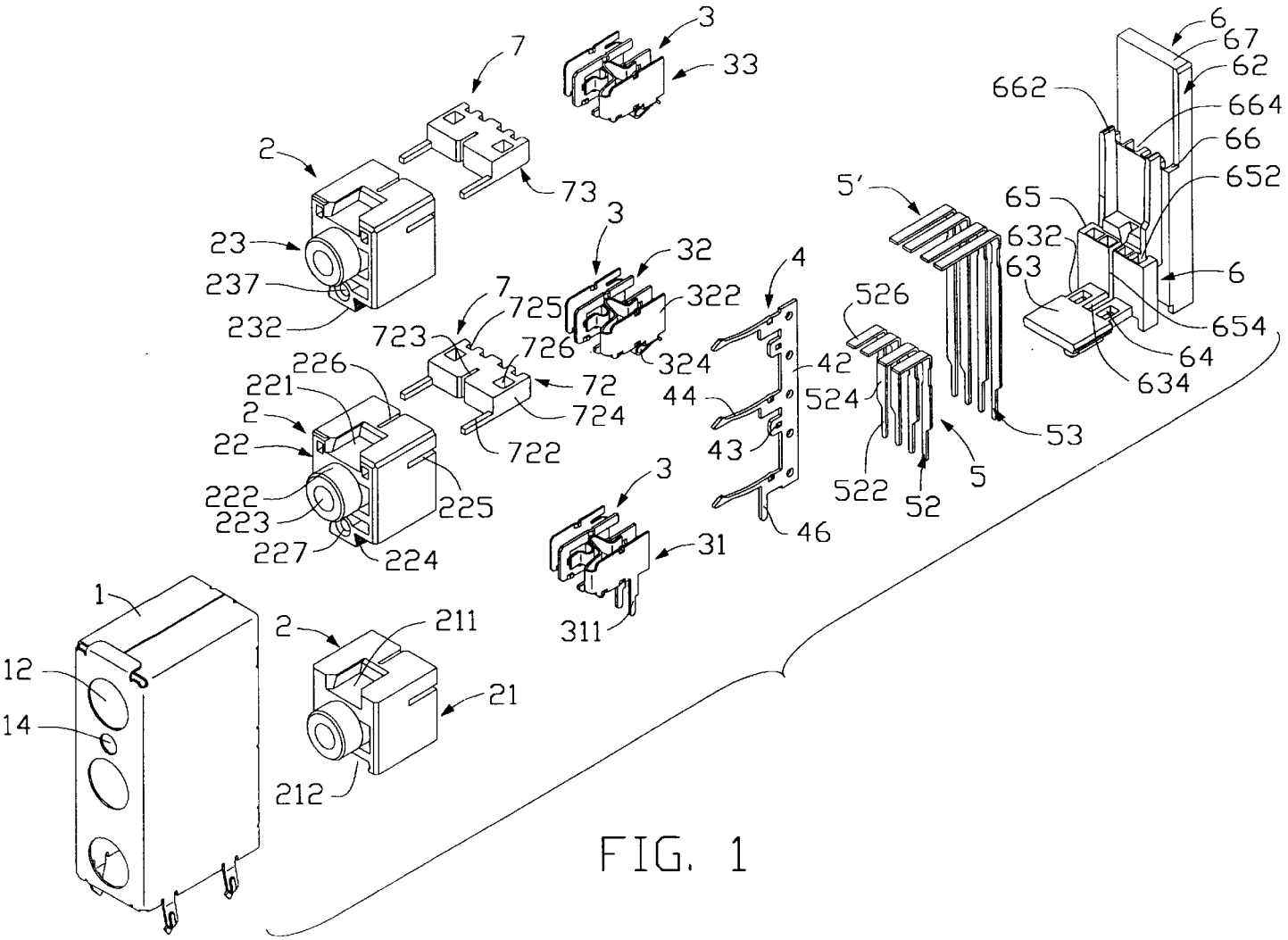
FIG. 1 is an exploded view of a triple stacked electrical connector of the present invention.

Referring to FIG. 1, a stacked electrical connector of the present invention comprises a dielectric housing group 2 including a bottom, a middle and a top housings designated as 21, 22 and 23 arranged in an overlapped relationship, a set of conductive terminal groups 3 which comprises a bottom, a middle and a top terminal groups designated as 31, 32 and 33, a one-piece grounding contact 4, two sets of transition contacts designated as 5 and 5', a spacer 6 and a conductive shield 1.

Figure 2:
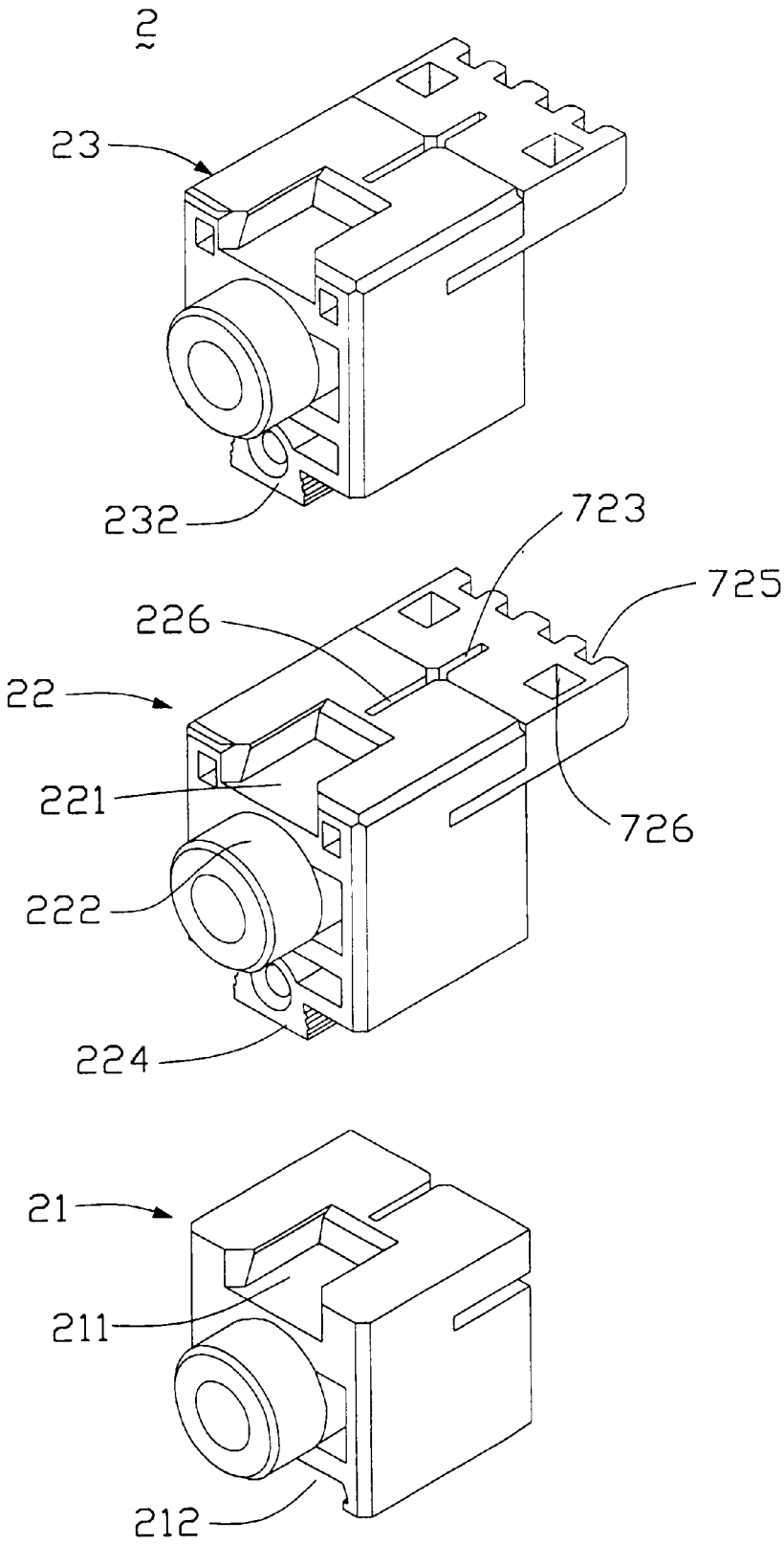
FIG. 2 is a first partially assembled view of FIG. 1.
Figure 3:
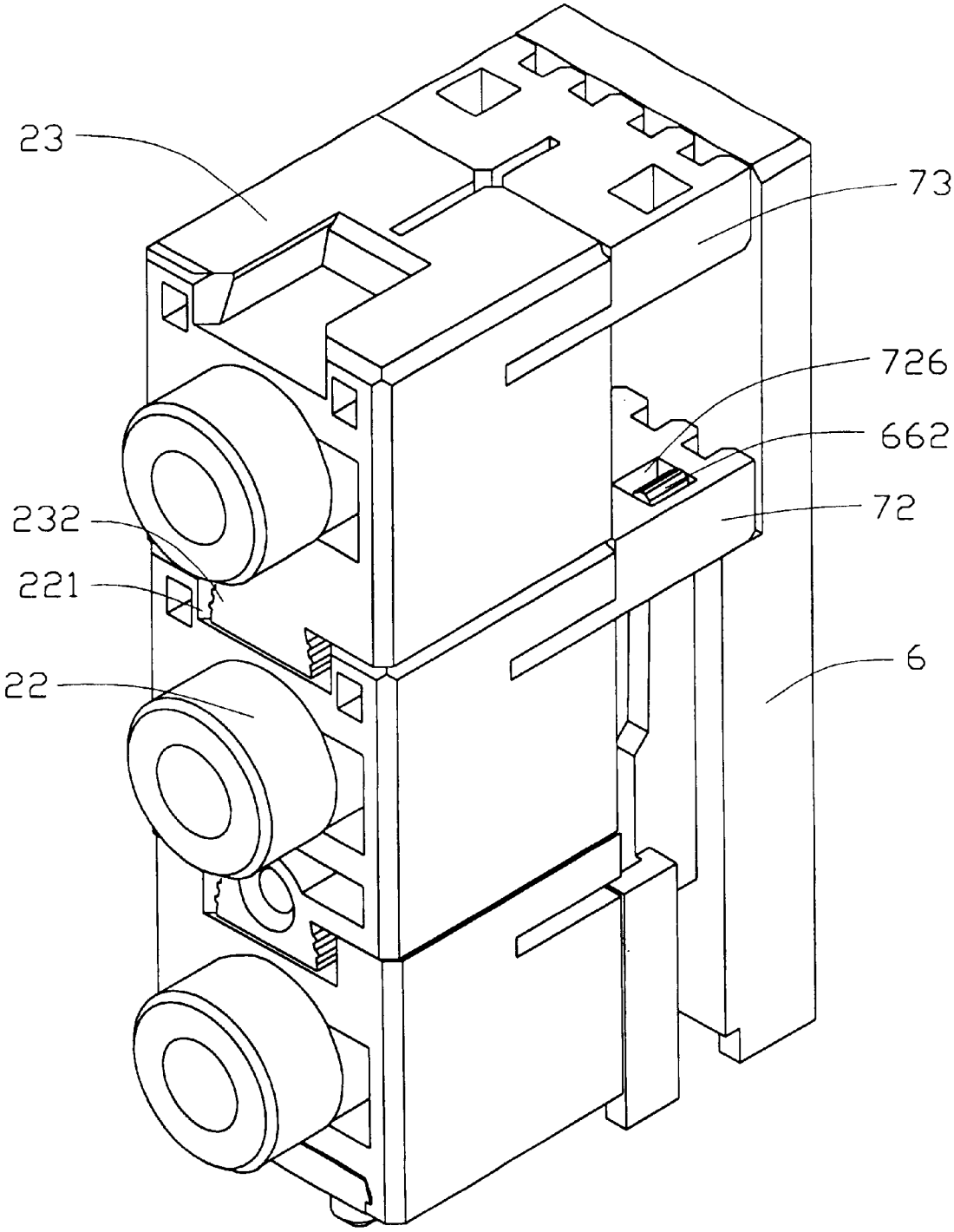
FIG. 3 is a second partially assembled view of FIG. 1.

Referring to FIGS. 1 and 2, the middle and the top housings 22 and 23 have an identical structure, so only the middle dielectric housing 22 will be detailed hereinafter. The middle housing 22 is rectangular shaped and comprises a front cylinder neck 222 which extends forward from a front face thereof and defines a through hole 223 for receiving a plug of a plug connector (not shown). A dove-tail recess 221 is defined in a front end of a top portion of the middle housing 22. A dove-tail protrusion 224, corresponding to a dove-tail recess 221 on the bottom housing 21, depends downward from a bottom surface of the middle housing 22. A slit 226 is defined in a rear end of the top portion of the middle housing 22. Additionally, a pair of side slots 225 are defined in opposite sides of the middle housing 22. The bottom housing 21 has a structure similar to that of the housing 22 or 23 with the exception that the dove-tail protrusion is eliminated and in its place is an enlarged recess 212 defined in the bottom surface of the bottom housing 21. An upper and a lower retaining blocks 73, 72 are prepared for respectively engaging with the housings 22, 23. Each retaining block 73, 72 comprises a body section 724 and a pair of retaining posts 722 extending forward from both sides of a front surface of the body section 724 for inserting in the pair of side slots 225 of each dielectric housing 22 or 23. The body section 724 defines a through slit 723 in a middle portion of the front end thereof, the through slit 723 aligning with the slit 226 of the middle housing 22. A plurality of grooves 725 is defined in a rear end thereof and a pair of through holes 726 is defined in both sides of the body section 724, extending from a top surface to a bottom surface thereof.

Figure 4:
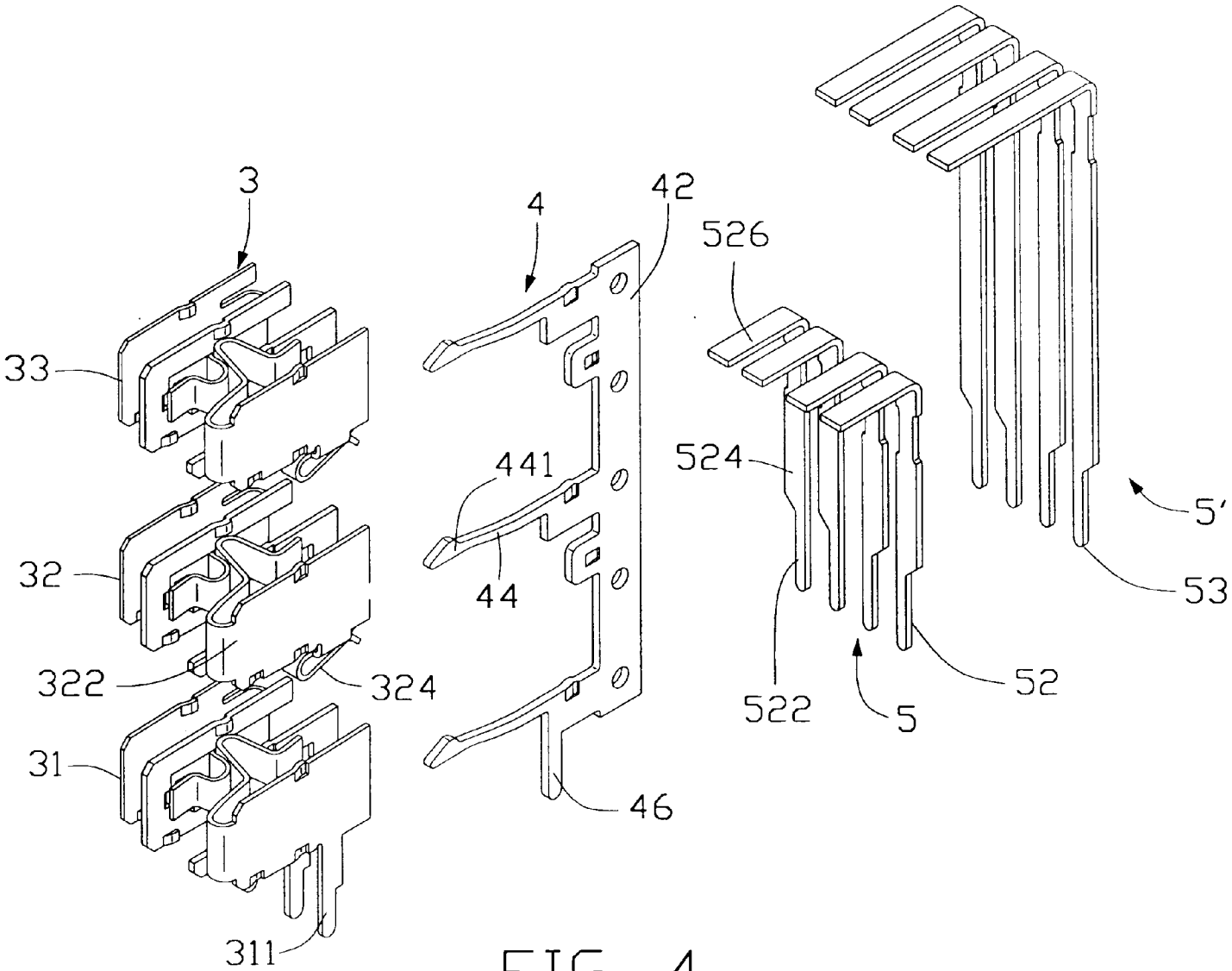
FIG. 4 is an enlarged view of the contacts of FIG. 1.
Figure 5:
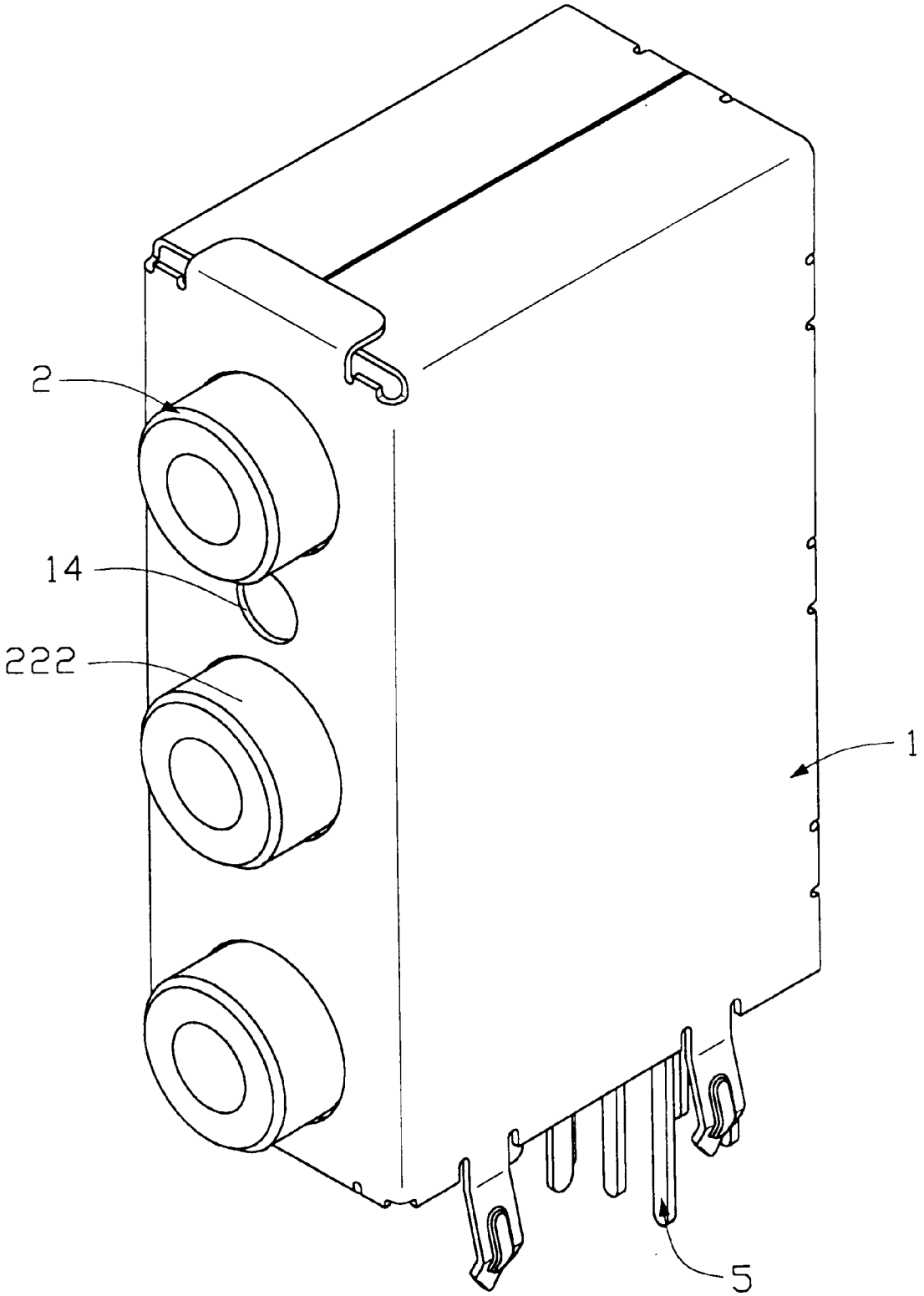
FIG. 5 is an assembled view of FIG. 1.

Referring to FIGS. 1 and 4, the conductive terminal groups 31, 32 and 33 each comprise four longitudinal conductive terminals parallel to one another. The middle and the top terminal groups 32, 33 have the same structure and each comprises a curved contacting portion 324 extending forwardly and rearwardly from a bottom edge of each terminal 322. The bottom terminal group 31 has a similar structure to those of the terminal groups 32 and 33 except that a contacting portion 311 depends downward from the bottom edge of each terminal for soldering to a printed circuit board (not shown) in place of the contacting portion 324 of the middle and the top terminal groups.

A one-piece grounding contact 4 comprises a vertical body strip 42 and three arms 44 horizontally extending forward therefrom. The arms 44 are spaced apart and parallel to one another for inserting in the three housings and between the four terminals 322 of each terminal group 31, 32, or 33. A pair of projections 43 extends forward from the body strip 42, one adjacent to the top and the other to the middle arms 44 respectively for inserting in the slits 226 of the middle and the bottom housings 22, 21. An insert leg 46 depends downward from the bottom contact arm 44 of the grounding contact 4 for soldering to the printed circuit board.

The two sets of transition contacts 5, 5' have a similar structure and each comprises a plurality of terminals 52, 53. Each terminal 52, 53 comprises a retaining portion 524, a tail portion 522 extending downward therefrom and a mating portion 526 bent at a right angle therefrom to mate with a respective contacting portion 324 of the conductive terminal groups 32 and 33.

The spacer 6 is generally step-shaped and comprises a base 63 received in the recess 212 in the bottom housing 21 and a vertical panel 62 extending upward from a rear end of the base 63. The base 63 forms a rear portion wherein a pair of shoulders 632 are defined at the sides thereof and a pair of first groove 64 are defined between the shoulders 632. Additionally, a slot 634 is defined between the grooves. The vertical panel 62 comprises a first step 65, a second step 66 and third step 67. The first step 65 defines four second through grooves 652 extending from a top surface to a bottom surface thereof for receiving the retaining portions of the transition contacts 5. A through slot 654 is defined in a center portion of the first step 65 and communicates with the slot 634 of the base 63 for receiving the strip 42 of the grounding contact 4. The second step 66 also defines four third through grooves 664 for receiving the retaining portions (not labeled) of the transition contacts 5'. A pair of latching posts 662 extend upward at both sides of the second step 66 for latching the pair of through holes 726 of the lower retaining block 72.

The conductive shield 1 is rectangular shaped for enclosing the three stacked dielectric housing 21, 22 and 23 and the two sets of the transition contacts 5, 5' and comprises three first openings 12 corresponding to the front necks 222 of the three dielectric housing 21, 22, and 23 and a second opening 14 defined between the upper two openings 12 for aligning with the screw hole 227 of the top housing 23.

In assembly, referring to FIGS. 1 through 5, the three dielectric housing 21, 22 and 23 are overlapped with the dove-tail protrusion 232 of the top housing 23 engaging in the dove-tail recess 221 of the middle housing 22 and the dove-tail protrusion 224 of the middle housing 22 engaging in the dove-tail recess (not labeled) of the bottom housing 21. Each mating portion 526 of the two sets of transition contacts 5, 5' are inserted in a respective contacting portion 324 of the middle and the top conductive terminal groups 32, 33 respectively. The three conductive terminal groups 31, 32, and 33 are respectively inserted in the dielectric housing 21, 22 and 23 from rear ends of the three housings. The three contact arms 44 of the grounding contact 4 are respectively inserted in the three stacked housings and between the four terminals 322 of each terminal group 31, 32 or 33, the pair of projections 43 retained in the slits 226 of the middle and the bottom housing 22, 21. The upper and the lower retaining blocks 72, 73 engage respectively with the housings 22, 23 by the pair of retaining posts 722 thereof inserting in a respective pair of side slots 225 of the housing 22 or 23, the through slits 723 thereof engaging with the body strip 42 of the grounding contact 4. Then the above-mentioned assembly engages with spacer 6, wherein the bottom dielectric housing 21 is mounted to the base 63 with the recess 212 thereof engaging the base 63 and the four contacting portions 311 thereof inserted through the pair of first grooves 64 and shoulders 632 of the base. The retaining portions of the transition contacts 5' pass through the grooves 725 of the lower retaining block 72 and are received in the third grooves 664 of the second step 66 and the retaining portions 522 of the transition contact 5 are received in the second grooves 652 of the first step 65. The pair of latching posts 662 latch in the pair of through holes 726 of the lower retaining block 72 to fix the stacked dielectric housings against the spacer 6. The body strip 42 of the grounding contact 4 is retained in the vertical slot 654 of the second step 65 and the insert leg 46 thereof inserts through the slit 634 of the base 63 for soldering to the printed circuit board. Finally, the conductive shield 1 encloses the three stacked dielectric housing 21, 22 and 23 and the two sets of transition contact 5, 5' to complete the whole assembly of the stacked electric connector of the present invention with the front necks 223 of the three housings extending out of the respective first openings 12 and the screw hole 227 of the top housing 22 aligning with the second opening 14 thereof for insertion of a bolt (not shown) to fix the stacked electrical connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical connector comprising:

a bottom, a middle and a top dielectric housings being arranged in an overlapped relationship, each housing having a front neck defining a mating hole for mating with a plug connector and having a pair of slots at opposite sides thereof;

an upper and a lower retaining block each defining a pair of retaining posts extending from a front surface thereof to engage with the pair of slots of one of the middle housing and the top housing, the lower retaining block having a pair of through holes in both sides thereof;

a bottom, a middle and a top conductive terminal group being respectively inserted in the bottom, the middle and the top dielectric housings and each comprising a plurality of terminals, the middle and the top conductive terminal groups having the same structure and each terminal thereof having a lower contacting portion, the bottom terminal group having a plurality of depending contacting portions for being soldered to a printed circuit board;

a first set of transition contacts and a second set of transition contacts having a similar structure, each transition contact comprising a retaining portion, a tail portion depending therefrom for soldering to the printed circuit board and a mating portion for engaging with a respective contacting portion of the terminals of the middle and the top conductive terminal groups;

a one-piece grounding contact having a body strip and three contact arms extending therefrom to insert in the three stacked dielectric housings and between the terminals of each conductive terminal group;

a spacer comprising a base received in a bottom of the bottom dielectric housing and a vertical panel rearward of the dielectric housings, the panel comprising a first and a second step in a gradually rising sequence, the first and the second steps each defining a plurality of grooves for respectively receiving the retaining portions of the transition contacts, the second step forming a pair of latching posts extending upwardly from opposite sides thereof to latch in the pair of through holes of the lower retaining block; and a conductive shield enclosing the three stacked dielectric housings and the transition contacts;

wherein the middle and the top dielectric housings have an identical structure and each comprises a recess in a top surface thereof and a protrusion extending from a bottom surface thereof, the protrusion of the top dielectric housing being engaged with the recess of the middle dielectric housing;

wherein the plurality of terminals of each conductive terminal group are generally parallel to each other;

wherein the contacting portions of each of the middle and the top conductive terminal groups are curved and extend forwardly and rearwardly from a bottom edge thereof;

wherein the base of the spacer defines a pair of shoulders and a pair of grooves between the shoulders for engaging with the plurality of depending contacting portions of the bottom terminal group;

wherein a vertical slot and a through slit aligning with the vertical slot are respectively defined in a middle portion of the second step of the spacer and a forward middle portion of the lower retaining block for receiving the strip of the grounding contact;

wherein the middle housing defines in a top surface thereof a slit aligning with the through slit of the lower retaining block and a projection extends from the strip of the grounding contact to engage with the slit of the middle housing;

wherein the base of the spacer defines a central slot communicating with the through slot of the second step of the spacer and the grounding contact comprises an insert depending leg inserted through the central slot of the base of the spacer for soldering to the printed circuit board.

* * * * *